US011350733B1

(12) United States Patent
Suarez

(10) Patent No.: US 11,350,733 B1
(45) Date of Patent: Jun. 7, 2022

(54) REVERSIBLY MOUNTED SLIDING SURFACE EXTENSION TRAY

(71) Applicant: Julie Suarez, Bonita Springs, FL (US)

(72) Inventor: Julie Suarez, Bonita Springs, FL (US)

( * ) Notice: Subject to any disclaimer, the term of this patent is extended or adjusted under 35 U.S.C. 154(b) by 0 days.

(21) Appl. No.: 17/180,167

(22) Filed: Feb. 19, 2021

(51) Int. Cl.
*A47B 1/10* (2006.01)
*A47B 1/05* (2006.01)

(52) U.S. Cl.
CPC ..... *A47B 1/10* (2013.01); *A47B 1/05* (2013.01); *A47B 2200/004* (2013.01); *A47B 2200/008* (2013.01)

(58) Field of Classification Search
CPC .. A47B 17/03; A47B 1/05; A47B 1/10; A47B 13/081; A47B 2200/004; A47B 2200/008; A47B 2021/0307; A47B 21/0314
See application file for complete search history.

(56) References Cited

U.S. PATENT DOCUMENTS 3,910,659 A * 10/1975 Peterson ..... A47B 13/081 312/226
5,460,105 A * 10/1995 Given, Jr. ..... A47B 11/00 108/137
6,206,495 B1 * 3/2001 Peterson ..... A47B 21/0314 312/249.13
6,817,275 B1 * 11/2004 Chin-Chin ..... B23D 47/025 83/435.11
9,505,069 B2 * 11/2016 Frolov ..... B23D 47/025
10,897,989 B1 * 1/2021 Mink ..... A47B 13/081
11,083,284 B1 * 8/2021 Koga ..... A47B 21/0314
11,089,868 B1 * 8/2021 Livingston, Jr. ..... B25H 1/04
2003/0213349 A1 * 11/2003 Chang ..... B27B 25/10 83/438
2007/0113928 A1 * 5/2007 Liu ..... B25H 1/10 144/286.5
2011/0219988 A1 * 9/2011 Stephens ..... A47B 13/081 108/6
2018/0020848 A1 * 1/2018 Mercier ..... A47F 5/005 108/61

* cited by examiner

*Primary Examiner* — Daniel J Rohrhoff
(74) *Attorney, Agent, or Firm* — Pharar Patents & Intellectual Property; Andrew A. Pharar

(57) ABSTRACT

The reversibly mounted sliding surface extension tray disclosed herein may be reversibly mounted on a flat surface and may provide an extendable tray or shelf for increasing the storage space available to a user. The device may extend or retract, as desired, so as to make use of available free space beyond a countertop or other flat surface. The device may be reversibly mounted to a surface by a vacuum mechanism, such as suction cup devices, by an adhesive, such as glue or tape, or by any other appropriate mechanism. The reversibly mounted sliding surface extension tray may further comprise a motorized design that allows for powered extension or retraction of the tray component.

6 Claims, 6 Drawing Sheets

REVERSIBLY MOUNTED SLIDING SURFACE EXTENSION TRAY

TECHNICAL FIELD OF THE INVENTION

The present invention relates in general to storage devices, and, more specifically, to a reversibly mounted sliding surface extension tray.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Storage devices are made available in a plurality of designs and sizes based on their intended purpose. One type of storage device may be a cabinet, which may generally comprise a square or rectangular container having an opening door on one side for access to its interior. A cabinet may be placed on a floor or mounted on a wall, and may further comprise a locking door to create a secure place for storing items.

Another type of storage device may be a drawer. As opposed to a cabinet, a drawer may generally comprise a square or rectangular container having an open top, and may slide on rails mounted within a frame. Like cabinets, drawers may also further comprise a locking mechanism that prevents the cabinet from sliding so as to protect its contents.

A shelf, on the other hand, is generally a flat surface for storing items that may or may not comprise surrounding surfaces. By way of example, a plurality of shelves may be installed within a frame, thus having side walls and, perhaps, a rear wall. A plurality of shelves may also be installed using brackets on a wall, and may thus not comprise side walls.

A countertop or other flat surface may also comprise a storage device, as various items may be placed on the surface for easy access. The advantage of placing items on a flat surface without walls is that all of the items are quickly visible and accessible without having to remove other items in front of or on top of the desired item. By way of example, a bathroom or kitchen countertop may incorporate a sink and provide storage area for items used within that sink.

The problem arises, though, when the bathroom or kitchen countertop space is too small for all of the items a person would prefer to store, or if the items need to be mixed or otherwise manipulated before being used and there is not sufficient space for storage. While cabinets, drawers, and shelves may provide additional storage space, they do not provide the readily viewable and accessible benefits of a countertop surface.

Thus, there is a need in the art for a reversibly mounted sliding surface extension tray that may be reversibly mounted on a flat surface and may provide an extendable tray or shelf for increasing the storage space available to a user. The reversibly mounted sliding surface extension tray may extend or retract, as desired, so as to make use of available free space beyond a countertop or other flat surface. It is to these ends that the present invention has been developed.

BRIEF SUMMARY OF THE INVENTION

To minimize the limitations in the prior art, and to minimize other limitations that will be apparent upon reading and understanding the present specification, the present invention describes a reversibly mounted sliding surface extension tray.

It is an objective of the present invention to provide a reversibly mounted sliding surface extension tray that may comprise a main body.

It is another objective of the present invention to provide a reversibly mounted sliding surface extension tray that may comprise a mounting base.

It is another objective of the present invention to provide a reversibly mounted sliding surface extension tray that may comprise a plurality of slide posts.

It is another objective of the present invention to provide a reversibly mounted sliding surface extension tray that may comprise a retaining bracket.

It is another objective of the present invention to provide a reversibly mounted sliding surface extension tray that may comprise a plurality of slide rails.

It is another objective of the present invention to provide a reversibly mounted sliding surface extension tray that may comprise a structural lattice.

It is another objective of the present invention to provide a reversibly mounted sliding surface extension tray that may comprise an attachment mechanism.

It is another objective of the present invention to provide a reversibly mounted sliding surface extension tray that may comprise a plurality of suction cups.

It is another objective of the present invention to provide a reversibly mounted sliding surface extension tray that may comprise a plurality of adhesive pads.

It is another objective of the present invention to provide a reversibly mounted sliding surface extension tray that may comprise a motorized mechanism.

It is another objective of the present invention to provide a reversibly mounted sliding surface extension tray that may comprise a slide motor.

It is another objective of the present invention to provide a reversibly mounted sliding surface extension tray that may comprise a plurality of drive wheels.

It is another objective of the present invention to provide a reversibly mounted sliding surface extension tray that may comprise an outer layer.

It is another objective of the present invention to provide a reversibly mounted sliding surface extension tray that may comprise an outer insulating layer.

It is another objective of the present invention to provide a reversibly mounted sliding surface extension tray that may comprise an outer traction layer.

It is another objective of the present invention to provide a reversibly mounted sliding surface extension tray that may comprise a plurality of partitions.

It is another objective of the present invention to provide a reversibly mounted sliding surface extension tray that may comprise a resilient material of construction.

It is another objective of the present invention to provide a reversibly mounted sliding surface extension tray that may comprise a water-proof material of construction.

It is another objective of the present invention to provide a reversibly mounted sliding surface extension tray that may comprise a rust-proof material of construction.

It is another objective of the present invention to provide a reversibly mounted sliding surface extension tray that may comprise a reusable material of construction.

It is another objective of the present invention to provide a reversibly mounted sliding surface extension tray that may comprise a multi-component construction.

It is another objective of the present invention to provide a reversibly mounted sliding surface extension tray that may comprise an antimicrobial layer.

It is another objective of the present invention to provide a reversibly mounted sliding surface extension tray that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The reversibly mounted sliding surface extension tray disclosed herein may be reversibly mounted on a flat surface and may provide an extendable tray or shelf for increasing the storage space available to a user. The device may extend or retract, as desired, so as to make use of available free space beyond a countertop or other flat surface. The device may be reversibly mounted to a surface by a vacuum mechanism, such as suction cup devices, by an adhesive, such as glue or tape, or by any other appropriate mechanism. The reversibly mounted sliding surface extension tray may further comprise a motorized design that allows for powered extension or retraction of the tray component.

Figure 1:
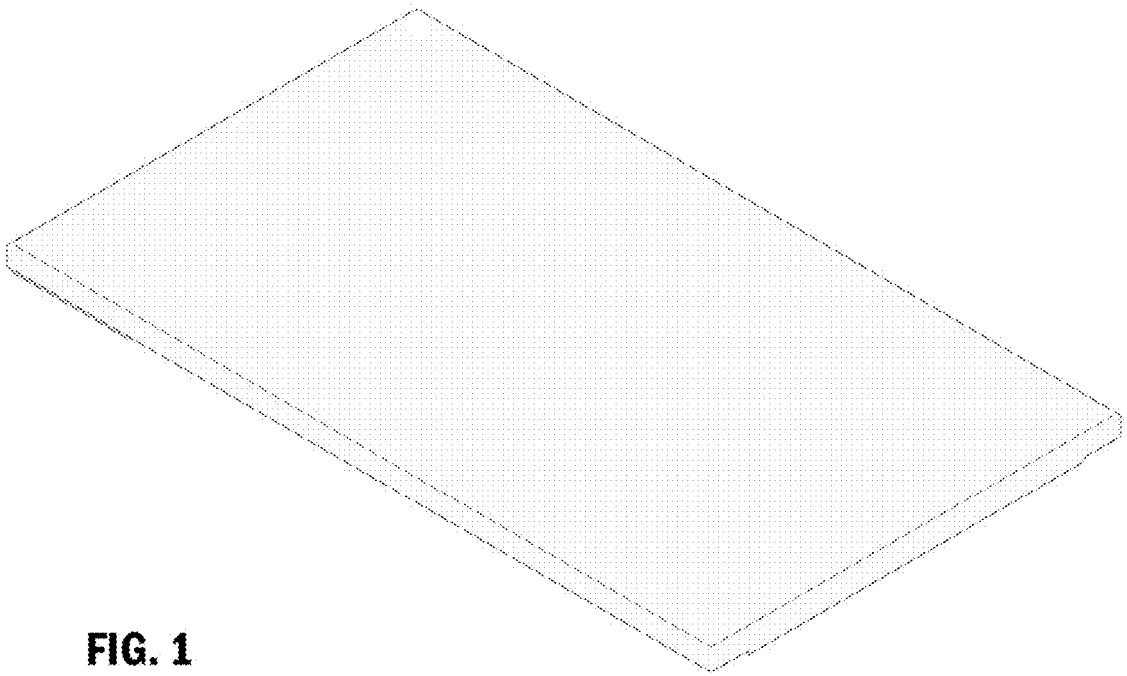
FIG. 1 is an isometric perspective view of a reversibly mounted sliding surface extension tray, as contemplated by the present disclosure.
Figure 2:
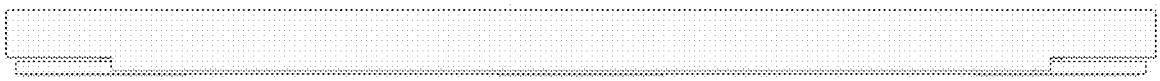
FIG. 2 is a left side elevation view of a reversibly mounted sliding surface extension tray, as contemplated by the present disclosure.
Figure 3:
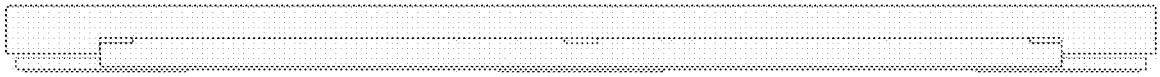
FIG. 3 is a right side elevation view reversibly mounted sliding surface extension tray, as contemplated by the present disclosure.
Figure 4:
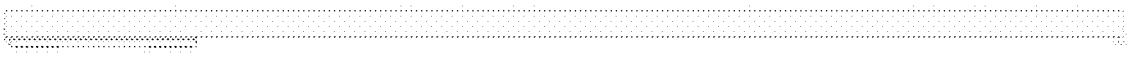
FIG. 4 is a front plan view of a reversibly mounted sliding surface extension tray, as contemplated by the present disclosure.
Figure 5:
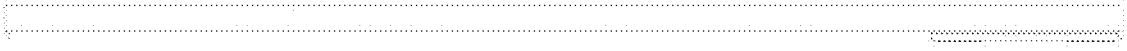
FIG. 5 is a rear plan view of a reversibly mounted sliding surface extension tray, as contemplated by the present disclosure.
Figure 6:
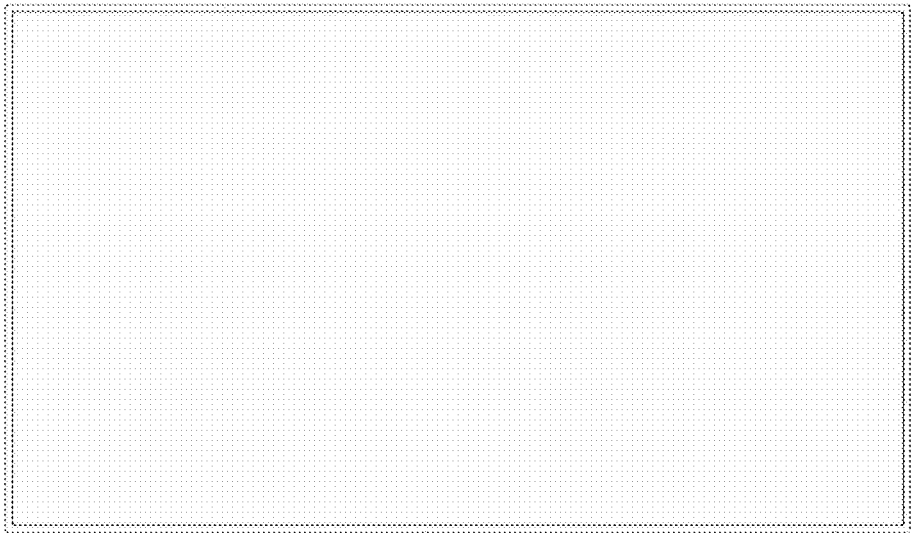
FIG. 6 is a top plan view of a reversibly mounted sliding surface extension tray, as contemplated by the present disclosure.
Figure 7:
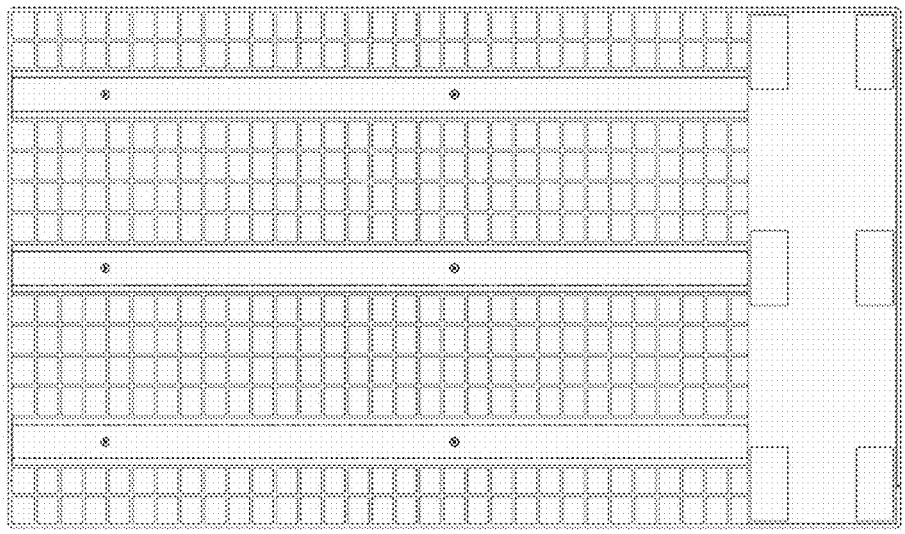
FIG. 7 is a bottom plan view of a reversibly mounted sliding surface extension tray, as contemplated by the present disclosure.
Figure 8:
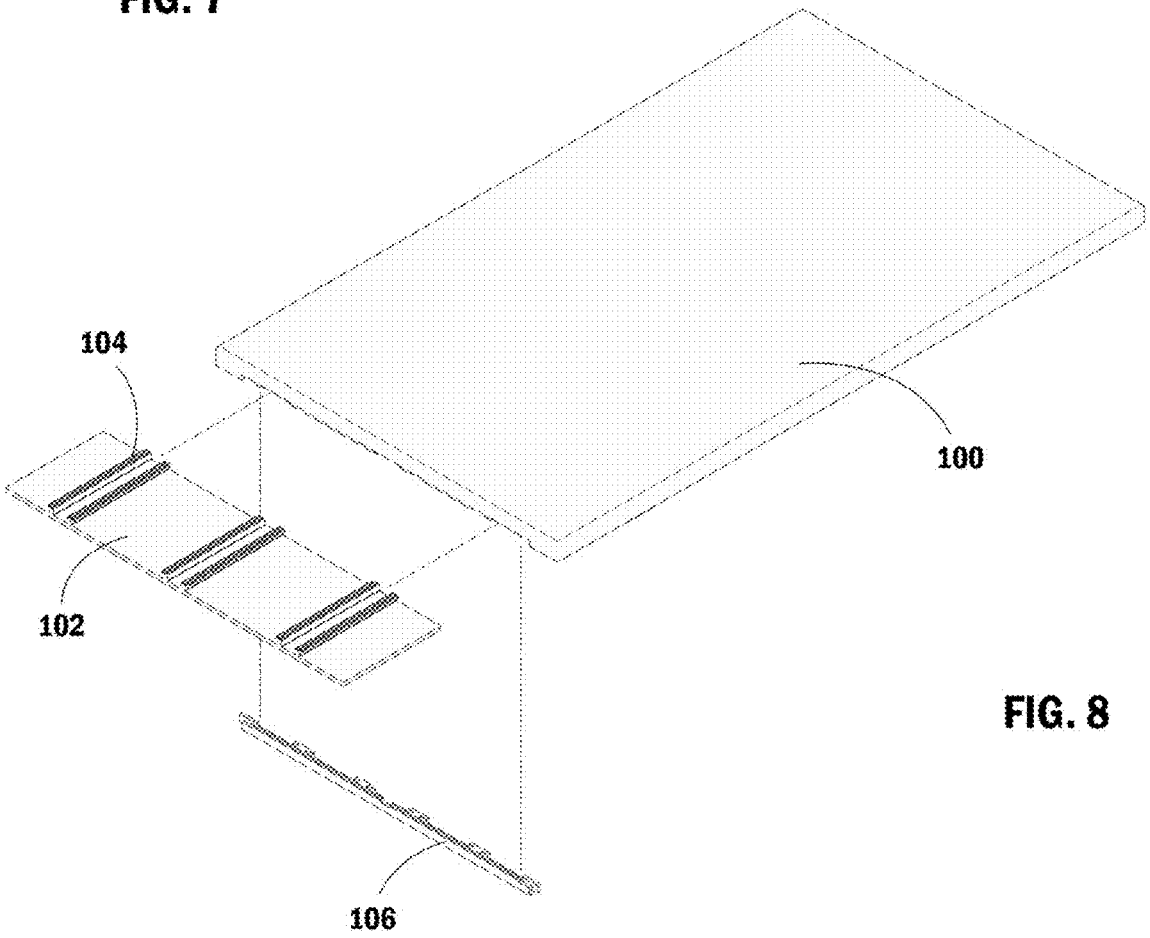
FIG. 8 is an isometric exploded view of a reversibly mounted sliding surface extension tray, as contemplated by the present disclosure.
Figure 9:
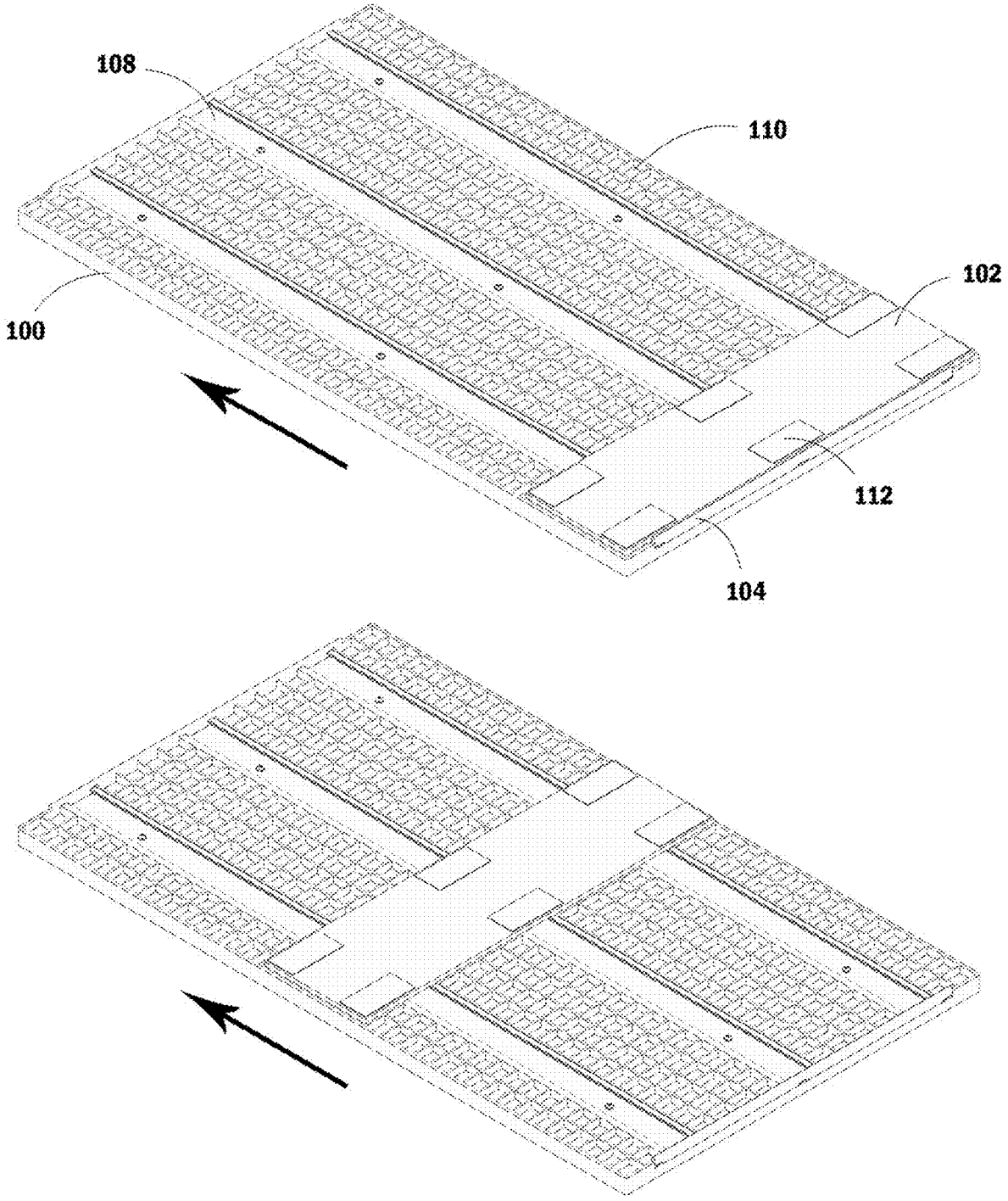
FIG. 9 is an isometric perspective bottom view of a reversibly mounted sliding surface extension tray showing a sliding action of a mounting base, as contemplated by the present disclosure.
Figure 10:
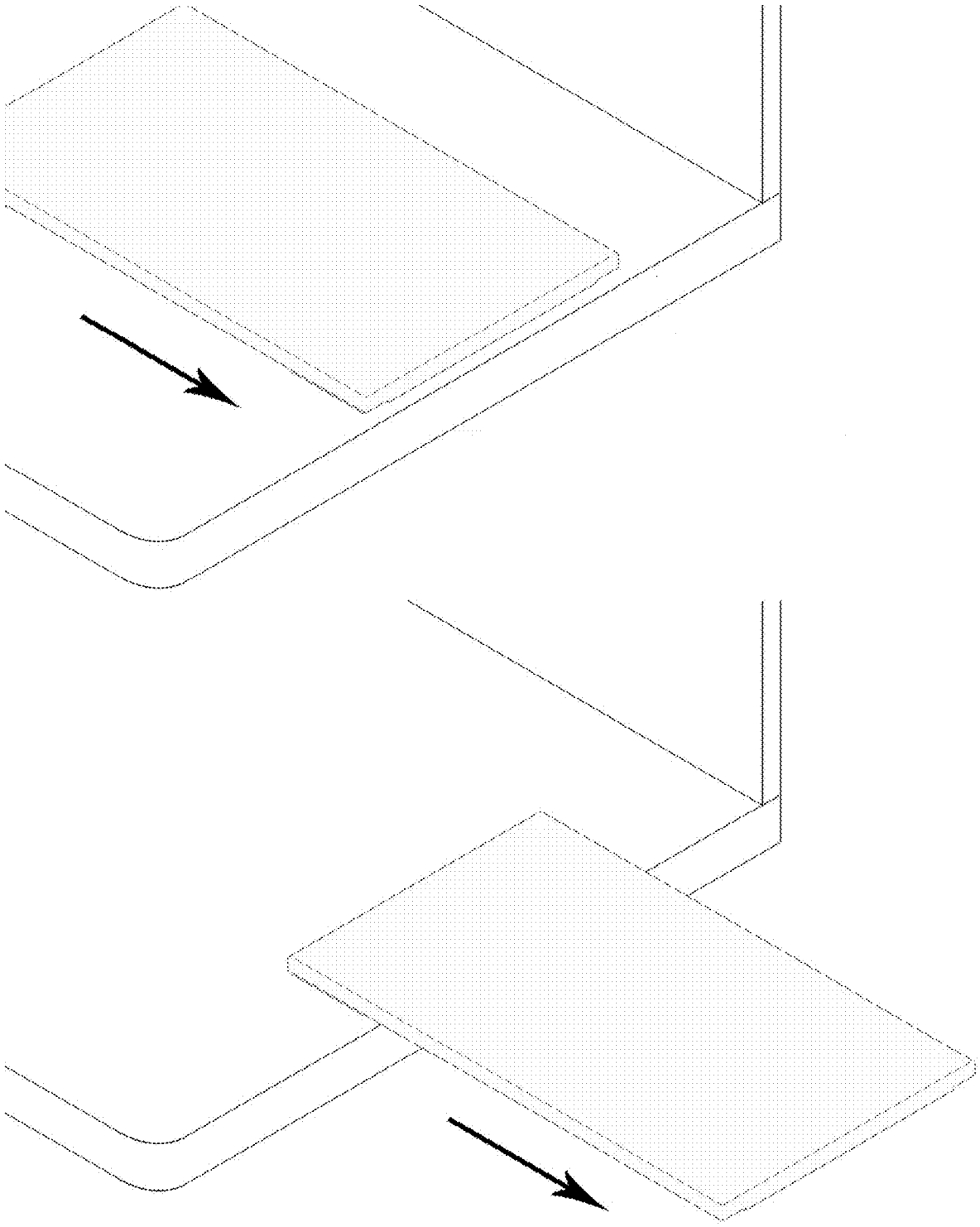
FIG. 10 is an isometric perspective top view of a reversibly mounted sliding surface extension tray showing a sliding action of the device, as contemplated by the present disclosure.
Figure 11:
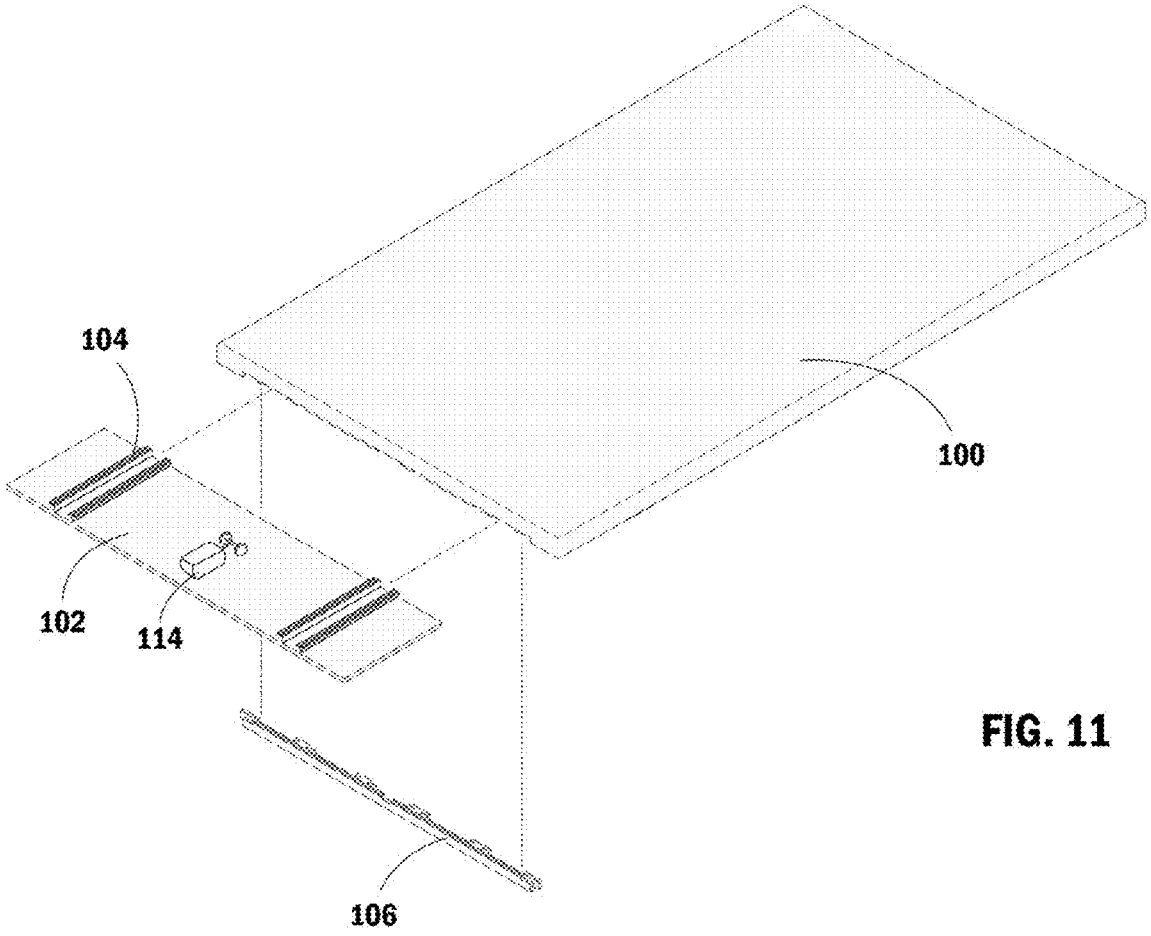
FIG. 11 is an isometric exploded view of a reversibly mounted sliding surface extension tray showing a motorized mechanism, as contemplated by the present disclosure.

The illustrations of FIGS. 1-11 illustrate a reversibly mounted sliding surface extension tray, as contemplated by the present disclosure. The device may comprise, generally, a main body 100, a mounting base 102, and a retaining bracket 106.

The main body 100 may comprise any appropriate shape such as, for example, a square or rectangular shape having an upper surface, a lower surface, and a plurality of sides. The upper surface of the main body 100 may be substantially horizontal and flat so as to provide a location onto which objects may be placed. The plurality of sides of the main body 100 may be substantially vertical relative to the upper surface.

The lower surface of the main body 100 may comprise a plurality of structures and implements that may facilitate the functioning of the device. By way of example, the lower surface of the main body 100 may comprise a plurality of slide rails 108 along which the mounting base 102 may reversibly slide. The lower surface of the main body 100 may further comprise a structural lattice 110, which may provide structural rigidity to the main body 100 while decreasing the total weight of the device.

One side of the main body 100 may comprise the retaining bracket 106, which may be removably attached to the main body 100 so as to allow for the installation and removal of the mounting base 102. The retaining bracket 106 may be attached to the main body 100 by any appropriate means such as, for example, friction fitting, snapping into place, or being secured with screws or bolts.

The mounting base 102 may further comprise an upper surface and a lower surface attached by a plurality of sides. The upper surface of the mounting base 102 may comprise a plurality of slide posts 104, which may be inserted into the plurality of slide rails 108 of the main body 100, and which may facilitate the relative movement of the main body 100 and the mounting base 102. The plurality of slide posts 104 may slide from a first end of the plurality of slides rails 108 to a second end of the plurality of slide rails 108, thus causing the mounting base 102 to move from one end of the main body 100 to the other end of the main body 100.

The lower surface of the mounting base 102 may comprise an attachment mechanism 112 that may allow the reversibly mounted sliding surface extension tray to be reversibly affixed to a flat surface. The attachment mechanism 112 may be any appropriate mechanism such as, for example, a plurality of suction cups or a plurality of adhesive pads.

The reversibly mounted sliding surface extension tray may further comprise a motorized mechanism 114. In one embodiment a slide motor and drive wheels combination may be installed on the mounting base 102 such that the motorized mechanism 114 inserts into one of the plurality of slide rails 108 and causes the relative movement of the mounting base 102 against the main body 100.

To begin using the reversibly mounted sliding surface extension tray a user may first remove the retaining bracket 106 from the main body 100 and install the mounting base 102 such that one each of the plurality of slide posts 104 is inserted into one of the plurality of slide rails 108. The retaining bracket 106 may then be reattached to the main body 100 such that it limits the lateral movement of the mounting base 102.

The mounting base 102 may then be reversibly attached to a flat surface via the attachment mechanism 112. Once the reversibly mounted sliding surface extension tray is attached to a flat surface the main body 100 may be slid relative to the mounting base 102 such that the mounting base 102 moves from the first end of the plurality of slides rails 108 to the second end of the plurality of slide rails 108. The user may place items on the upper surface of the main body 100 at any time, and may extend a flat surface using the main body 100 for additional storage space.

In an embodiment comprising a motorized mechanism 114 the user may press a plurality of buttons to start and stop the slide motor and drive wheels such that they facilitate the relative movement of the main body 100 against the mounting base 102. In one embodiment the motorized mechanism 114 may further comprise a near-field communication mechanism, such as a Bluetooth mechanism, so that the motorized mechanism 114 may be controlled by a proprietary software application on a mobile computing device.

In one embodiment the reversibly mounted sliding surface extension tray may further comprise an outer layer attached to the upper surface of the main body 100. The outer layer may be any appropriate layer designed to provide additional functionality to the device. By way of example, the outer layer may comprise a padding layer to provide a softer surface on the main body 100. By way of a second example, the outer layer may comprise a traction layer to prevent items from moving on the upper surface of the main body 100.

In one embodiment the reversibly mounted sliding surface extension tray may further comprise a plurality of partitions that may segment areas on the upper surface of the main body 100 for storage of particular objects. By way of example, one partition may comprise a circular raised area on the upper surface of the main body 100 that may allow a circular object to be retained within. Another partition may comprise a raised rectangular area into which pencils or other long devices may be placed and isolated.

The reversibly mounted sliding surface extension tray may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the reversibly mounted sliding surface extension tray may be substantially constructed of one or more materials of steel, aluminum, brass, fiberglass, carbon fiber, silicone, plastic, acrylic, polycarbonate, or combinations thereof. In some embodiments the various components of the device may be coated, lined, or otherwise insulated to prevent contamination of the device.

In one embodiment the reversibly mounted sliding surface extension tray may comprise a resilient material of construction that either comprises a material having antimicrobial properties or comprises a layering of antimicrobial material or coating. Antimicrobial properties comprise the characteristic of being antibacterial, biocidal, microbicidal, antifungal, anti-viral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A reversibly mounted sliding surface extension tray, comprising:

a main body;

a mounting base; and a retaining bracket;

wherein said main body comprises an upper surface and a lower surface;

wherein said lower surface of said main body further comprises a plurality of slide rails;

wherein said mounting base comprises an upper surface and a lower surface;

wherein said upper surface of said mounting base further comprises a plurality of slide posts;

wherein said lower surface of said mounting base further comprises an attachment mechanism;

wherein said attachment mechanism further comprises a plurality of suction cups;

wherein said retaining bracket is reversibly attached to said main body; and wherein said mounting base is reversibly attached to said main body.

2. The invention sliding surface extension tray of claim 1, wherein said mounting base is reversibly attached to said main body by inserting one each of said plurality of slide posts into one each of said plurality of slide rails; and wherein said retaining bracket limits a lateral range of motion of said mounting bracket base.

3. The sliding surface extension tray of claim 2, wherein said lower surface of said main body further comprises a structural lattice.

4. The sliding surface extension tray of claim 3, further comprising:

a motorized mechanism.

5. The sliding surface extension tray of claim 3, further comprising:

a Bluetooth device.

6. The sliding surface extension tray of claim 3, further comprising:

an outer layer;

wherein said outer layer is attached to said upper surface of said main body.

* * * * *